US010276932B2

(12) United States Patent
Venghaus et al.

(10) Patent No.: US 10,276,932 B2
(45) Date of Patent: Apr. 30, 2019

(54) ANTENNA POSITIONING SYSTEM

(71) Applicant: Winegard Company, Burlington, IA (US)

(72) Inventors: Brent Lee Venghaus, Mount Pleasant, IA (US); Orrin Ryan Lanz, Mediapolis, IA (US)

(73) Assignee: Winegard Company, Burlington, IA (US)

( * ) Notice: Subject to any disclaimer, the term of this patent is extended or adjusted under 35 U.S.C. 154(b) by 13 days.

(21) Appl. No.: 15/486,561

(22) Filed: Apr. 13, 2017

(65) Prior Publication Data

US 2018/0301784 A1 Oct. 18, 2018

(51) Int. Cl.

| | |
|---|---|
| ***H01Q 1/42*** | (2006.01) |
| ***H01Q 3/08*** | (2006.01) |
| ***H01Q 3/06*** | (2006.01) |
| ***H01Q 15/14*** | (2006.01) |
| ***H01Q 19/13*** | (2006.01) |

(52) U.S. Cl.
CPC ..... *H01Q 1/42* (2013.01); *H01Q 3/06* (2013.01); *H01Q 3/08* (2013.01); *H01Q 15/14* (2013.01); *H01Q 19/13* (2013.01)

(58) Field of Classification Search
CPC ..... H01Q 3/08; H01Q 19/138; H01Q 13/00
USPC ..... 343/766, 780, 754, 786
See application file for complete search history.

(56) References Cited

U.S. PATENT DOCUMENTS

| | | | | |
|---|---|---|---|---|
| 2,583,747 | A * | 1/1952 | Potter | H01Q 3/04 191/1 R |
| 3,091,766 | A | 5/1963 | Fryklund | |
| 3,372,603 | A | 3/1968 | Suliteanu et al. | |
| 4,109,251 | A * | 8/1978 | MacDougall | H01Q 1/084 343/715 |
| 4,358,843 | A | 11/1982 | Rager | |
| 4,503,530 | A | 3/1985 | Hinlein et al. | |
| 4,876,554 | A * | 10/1989 | Tubbs | H01Q 19/138 343/754 |
| 5,432,524 | A * | 7/1995 | Sydor | H01Q 1/3275 343/765 |
| 5,835,057 | A | 11/1998 | van Heyningen | |
| 5,982,333 | A * | 11/1999 | Stillinger | H01Q 3/08 342/359 |
| 6,023,247 | A | 2/2000 | Rodeffer | |
| 6,111,542 | A | 8/2000 | Day et al. | |
| 6,195,060 | B1 | 2/2001 | Spano et al. | |
| 6,313,805 | B1 | 11/2001 | Nishiyama | |
| 7,259,724 | B2 | 8/2007 | Young et al. | |
| 7,570,222 | B2 | 8/2009 | King | |
| 8,169,377 | B2 | 5/2012 | Tippit et al. | |
| 8,174,456 | B2 | 5/2012 | Omori et al. | |

(Continued)

*Primary Examiner* — Peguy Jean Pierre
(74) *Attorney, Agent, or Firm* — Dorr, Carson & Birney PC

(57) ABSTRACT

An antenna positioning system has a spindle with a bearing surface extending upward from a base. An azimuth gear is centered on the base around the spindle. An antenna support rotatably supports the antenna to allow elevational rotation of the antenna. The antenna support also has a recess with a shape complementary to the bearing surface of the spindle so that the antenna support is rotatably supported on the spindle to allow azimuth rotation of the antenna. The bearing surface and recess can be substantially conical in shape. An azimuth motor on the antenna support engages the azimuth gear to control azimuth rotation of the antenna.

10 Claims, 11 Drawing Sheets

(56) References Cited

U.S. PATENT DOCUMENTS

| | | | | |
|---|---|---|---|---|
| 8,305,279 | B2 | 11/2012 | Young et al. | |
| 8,761,663 | B2 | 6/2014 | Kaplan et al. | |
| 9,083,072 | B2 | 7/2015 | Conrad et al. | |
| 9,160,441 | B2 | 10/2015 | Norin et al. | |
| 9,263,797 | B1 | 2/2016 | Hall et al. | |
| 2008/0278396 | A1 | 11/2008 | Blalock et al. | |
| 2013/0116824 | A1* | 5/2013 | Rosheim | B25J 9/16 700/258 |

* cited by examiner

ANTENNA POSITIONING SYSTEM

BACKGROUND OF THE INVENTION

Field of the Invention

The present invention relates generally to the field of systems for positioning an antenna, such as mobile satellite antennas. More specifically, the present invention discloses an antenna positioning system having an antenna support rotatably mounted on a spindle extending upward from the base as the bearing surface, with an azimuth gear centered around the spindle that engages an azimuth motor on the antenna support.

Statement of the Problem

A wide variety of antenna positioning systems have been used for many years. These typically include mechanisms allowing the position of the antenna to be controlled in both the azimuth and elevation directions. Some conventional antenna positioning systems use a support platform that mounted on a ball bearings or roller bearings attached to a base to provide azimuth rotation (i.e., rotation about a vertical axis) for the antenna. An elevation control mechanism is mounted on this support platform to support the antenna and provide control in the elevation direction (i.e., rotation about a horizontal axis). However, these conventional antenna position systems have a number of shortcomings.

The bearings used for mounting the support platform to the base are a relative expensive components, and typically requires careful alignment and maintenance of precise tolerances between the bearings and support platform during assembly. This adds to the cost of manufacture, and ultimately increases the cost of the antenna system to the consumer. It would be advantageous to eliminate the need for bearings to mount the support platform to the base and employ a simpler method of assembling these components. In particular, it would be beneficial if the support platform is largely self-aligning when installed on the base.

Also, the antenna electronics and positioning motors on the support platform require wiring for power, control and communications. Simply running wiring between the base and the support platform can result in undesirable entanglement, interference between the wiring and components, or an limited range of motion for the antenna positioning system. Therefore, a need exists for a means to provide wiring between the support platform and base that minimizes the risk of entanglement, maximizes the range of motion of the antenna positioning system, and can be easily installed during assembly of the antenna system.

Solution to the Problem

The present invention addresses these shortcomings in the prior art by providing an antenna positioning system with a support platform mounted on a spindle extending upward from the base. The support platform and spindle can be equipped with complementary conical bearing surfaces that are self-aligning to simplify assembly and reduce costs by eliminating the need for a bearing. In addition, the spindle can be hollow so that wiring can pass upward through the spindle to the antenna and other components on the support platform.

SUMMARY OF THE INVENTION

This invention provides an antenna positioning system having a spindle with a bearing surface extending upward from a base. An azimuth gear is centered on the base around the spindle. An antenna support rotatably supports the antenna to allow elevational rotation of the antenna. The antenna support also has a recess with a shape complementary to the bearing surface of the spindle so that the antenna support is rotatably supported on the spindle to allow azimuth rotation of the antenna. The bearing surface and recess can be substantially conical in shape. An azimuth motor on the antenna support engages the azimuth gear to control azimuth rotation of the antenna.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
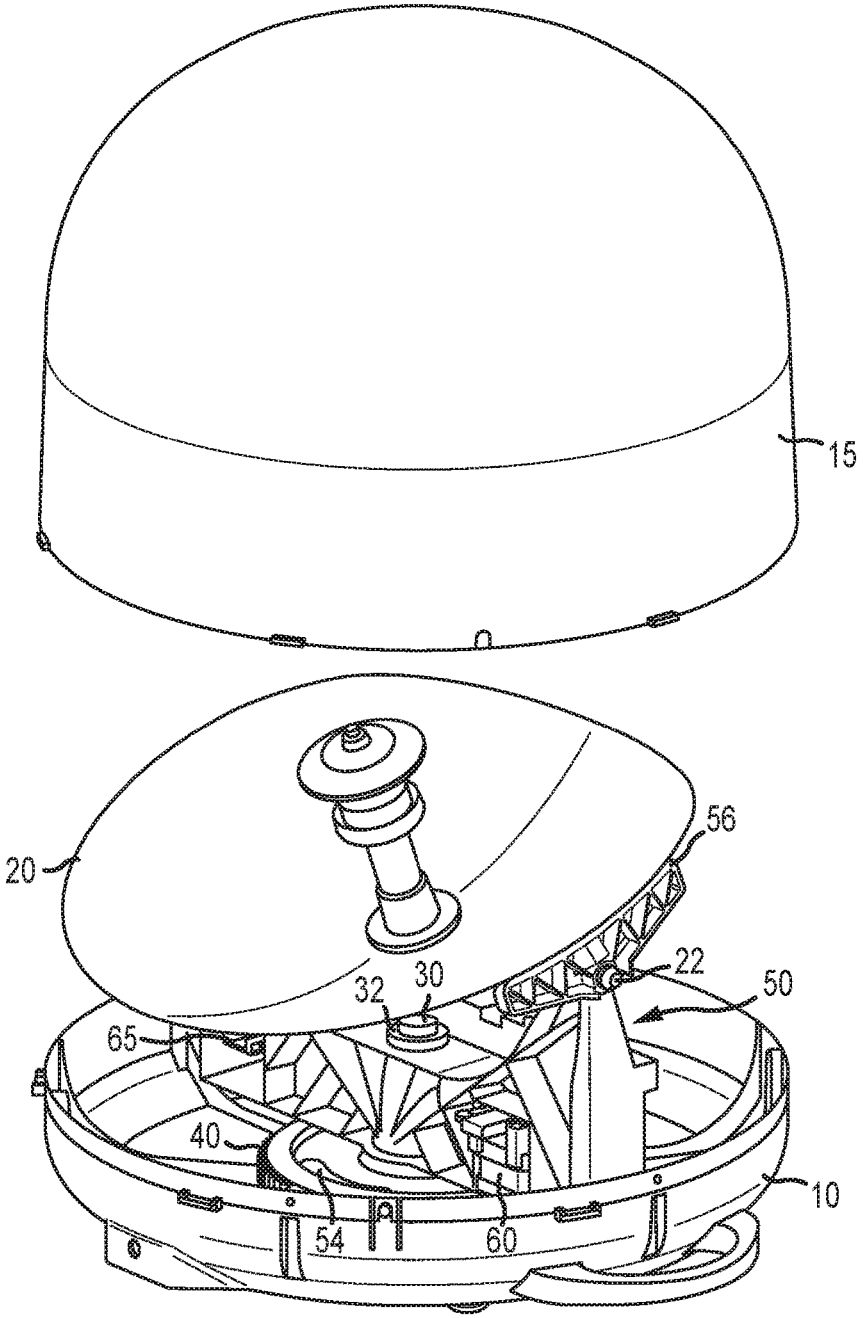
FIG. 1 is an exploded top axonometric view of an embodiment of the present antenna positioning system.

Turning to FIG. 1, an exploded view is shown of an embodiment of the present invention. As an overview, the antenna positioning system includes a base 10 supporting the entire assembly. An antenna support 50 supports the antenna 20 on the base 10 while also providing antenna positioning in the azimuth and elevation directions. The antenna 20 can be any conventional directional antenna, such as a dish antenna for satellite or terrestrial communications, or for receiving television signals. The antenna 20 typically includes a reflector and associated electronics for signal communications.

Figure 2:
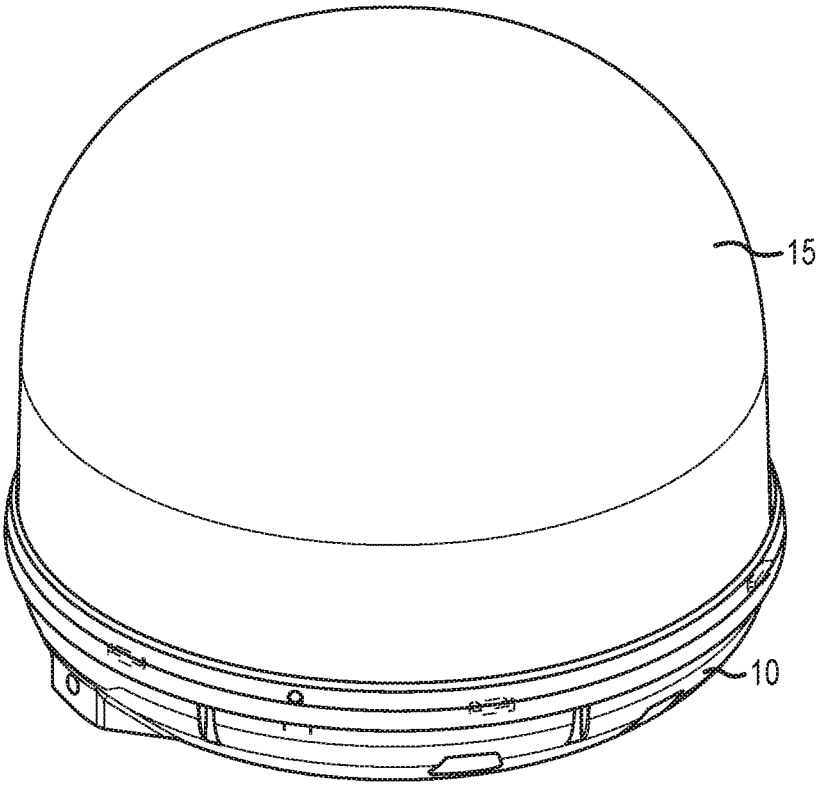
FIG. 2 is a top axonometric view of the assembled antenna system corresponding to FIG. 1.
Figure 3:
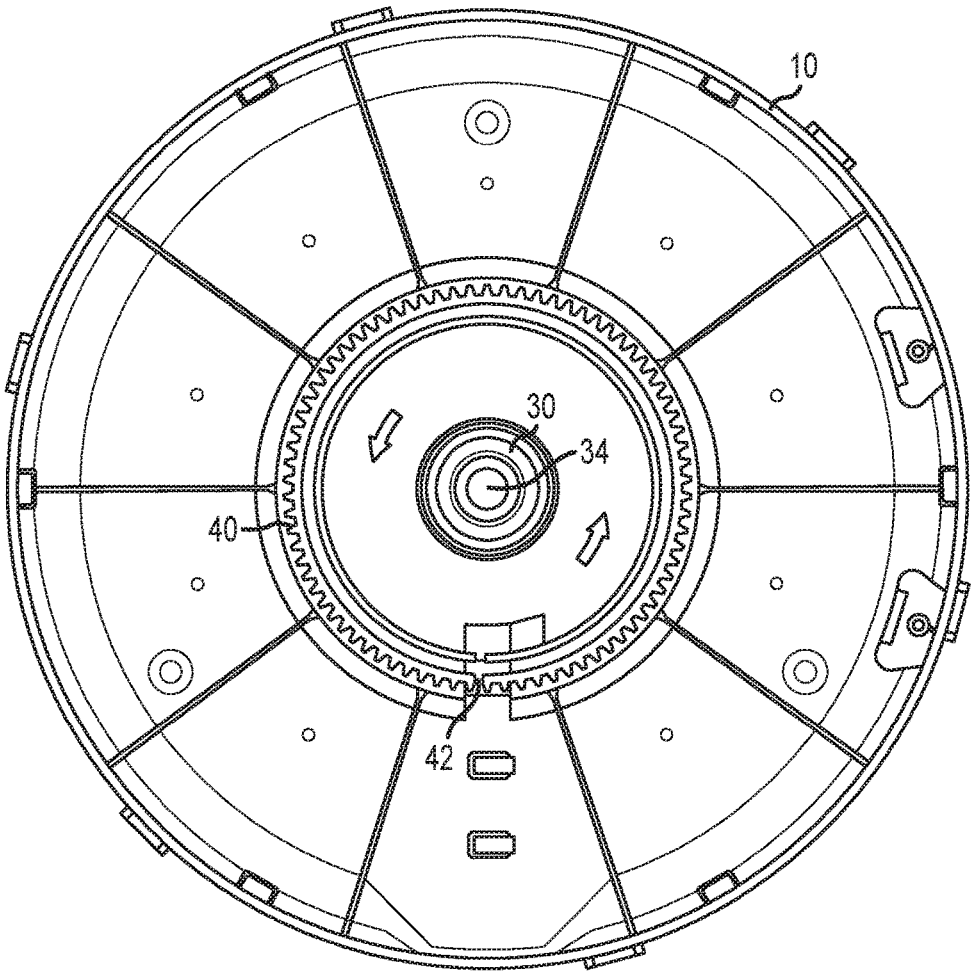
FIG. 3 is a top view of the base 10.

FIG. 3 is a top view of the base 10. This embodiment is intended for use with a removable dome 15 that encloses the antenna 20 and antenna support 50, and creates a carrying case for the antenna assembly when attached to the base 10, as shown in FIG. 2. However, the base 10 could have any desired configuration suitable for supporting the antenna 20.

Figure 4:
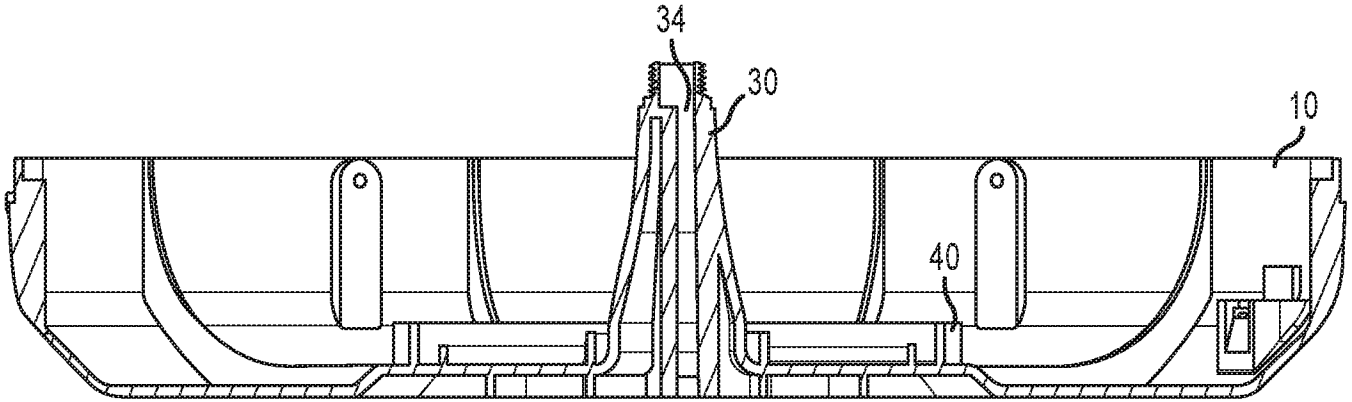
FIG. 4 is a side cross-sectional view of the base 10, azimuth gear 40 and spindle 30.
Figure 6:
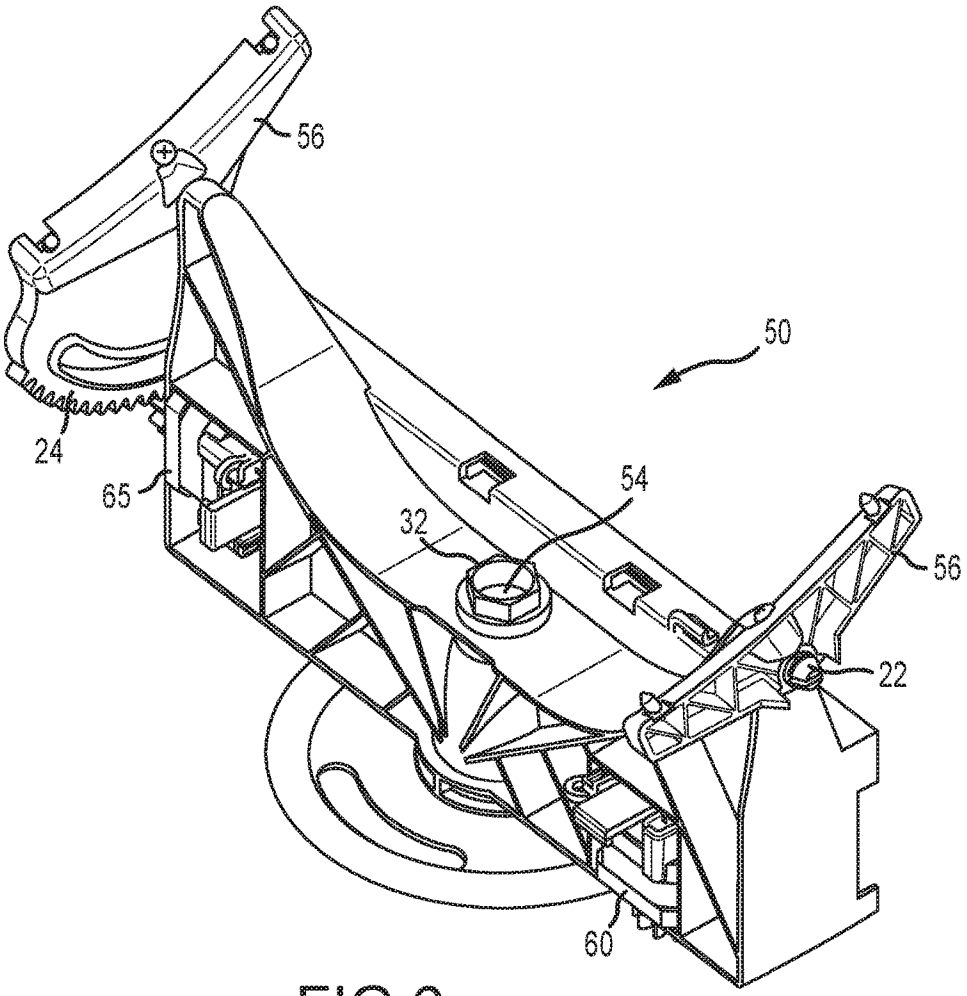
FIG. 6 is a top axonometric view of the antenna support assembly 50.
Figure 7:
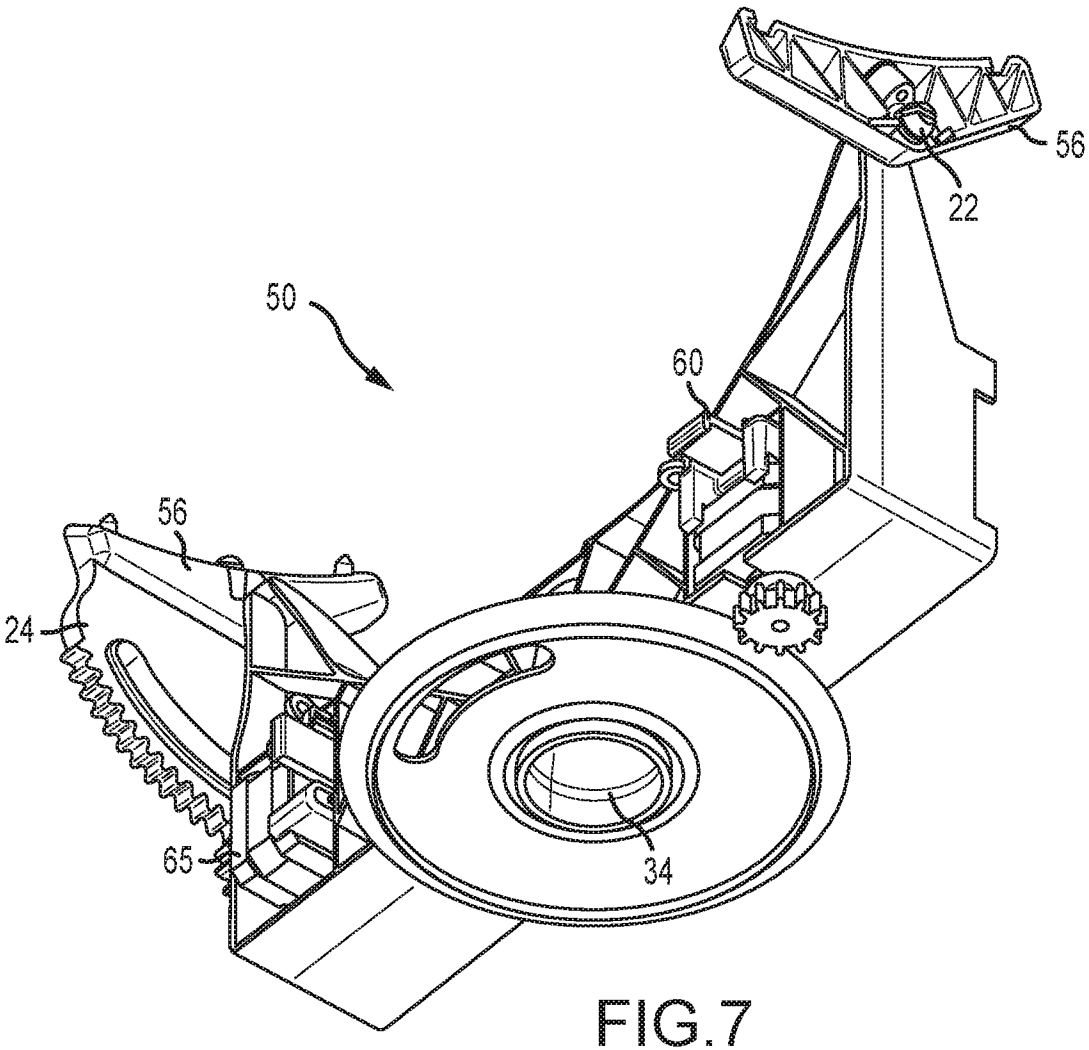
FIG. 7 is a bottom axonometric view of the antenna support assembly 50 corresponding to FIG. 6.
Figure 8:
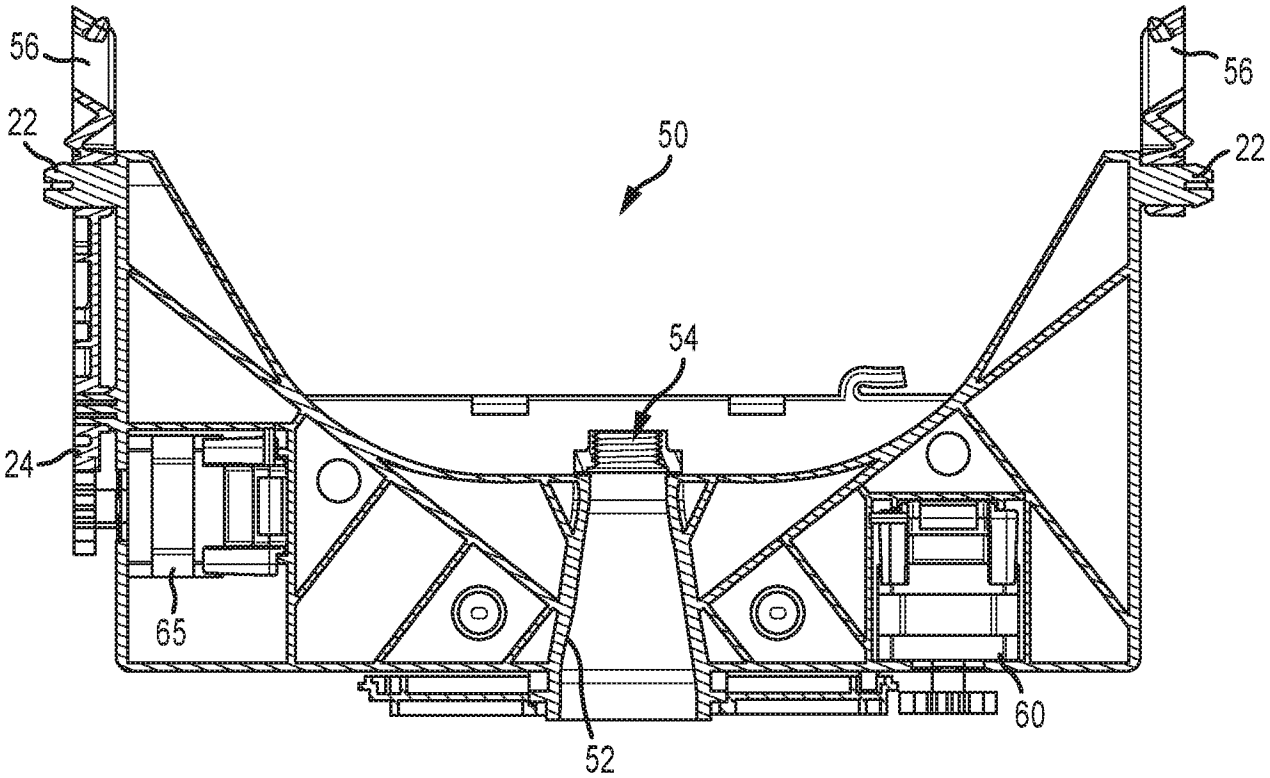
FIG. 8 is a cross-sectional view of antenna support assembly 50 corresponding to FIGS. 6 and 7.
Figure 9:
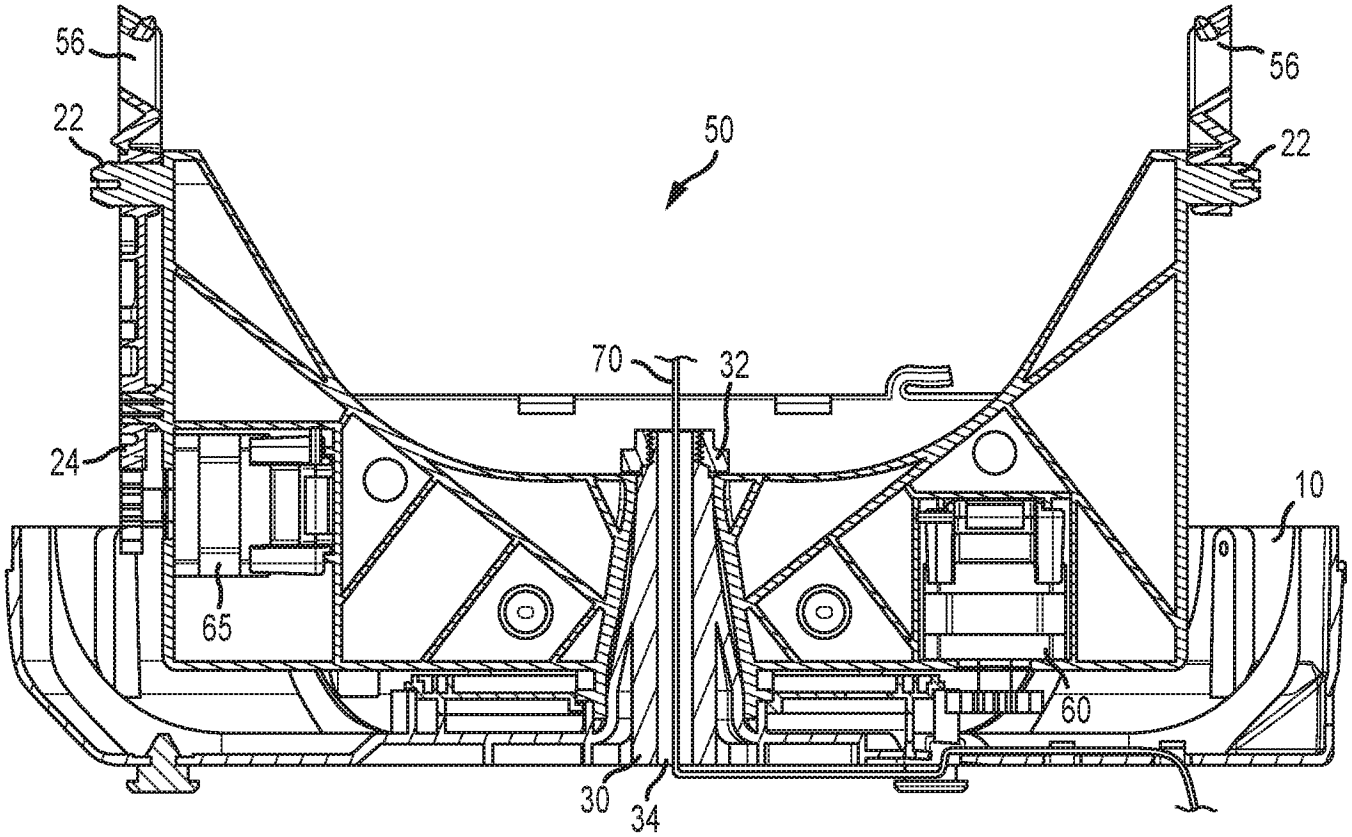
FIG. 9 is a cross-sectional view of the antenna support 50 mounted on the spindle 30 and base 10.

FIG. 4 is a side cross-sectional view of the base 10 showing the spindle 30 extending upward. This spindle 30 has an exterior surface that serves as a bearing surface for azimuth rotation of the antenna support 50. FIGS. 6 and 7 are top and bottom axonometric views of the antenna support 50. FIG. 8 is a corresponding cross-sectional view of antenna support 50. As illustrated in these drawings, the underside of the antenna support 50 includes a recess 52 having a bearing surface complementary to that of the spindle 30, so that the antenna support 50 is seated over, and rotatably supported on the spindle 30 to allow azimuth rotation of the antenna 20. FIG. 9 is a cross-sectional view of the antenna support 50 mounted on the spindle 30 and base 10. Preferably, the spindle 30 has a generally conical shape and the recess 52 in the antenna support 50 has a complementary conical shape. For the purposes of this application, the term "conical" should be broadly construed to include truncated conical or rounded conical shapes, etc. Optionally, the spindle 30 and recess 52 can also include a number of O-rings or washers to reduce friction and help to retain the antenna support 50 on the spindle 30.

A nut 32 can be threaded onto threads on the upper end of the spindle 30, as shown in FIGS. 4 and 6, to secure the antenna support 50 to the spindle 30. Alternatively, a cap can be attached to the upper end of the spindle 30 to secure the antenna support 50.

Figure 10A:
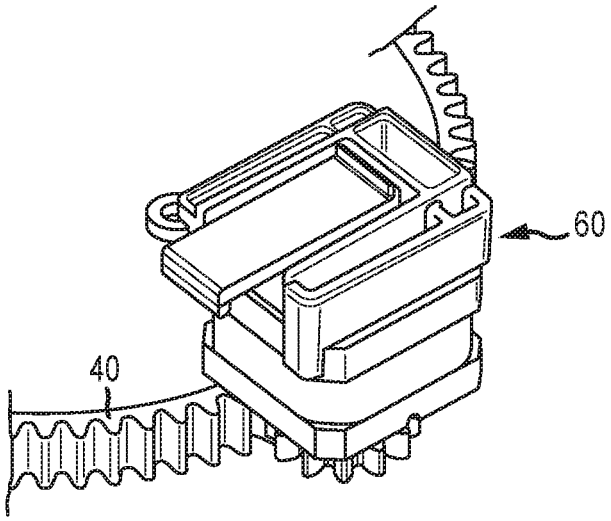
FIG. 10A is a detail axonometric view of the azimuth motor 60 and azimuth gear 40.
Figure 10B:
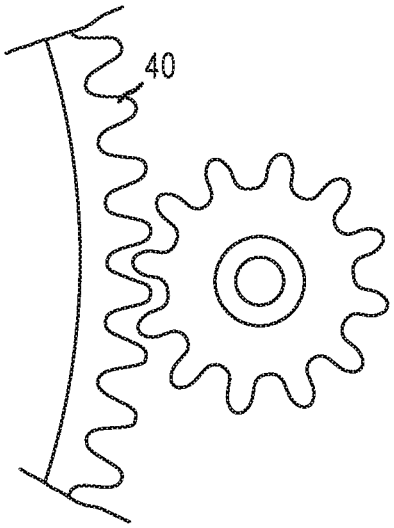
FIG. 10B is a detail bottom view of the pinion gear of the azimuth motor driving the azimuth gear 40, corresponding to FIG. 10A.

An azimuth gear 40 is mounted on top of the base 10 in a horizontal plane centered around the spindle 30, as shown in FIG. 3. An azimuth motor 60 is attached to the antenna support 50, so that a pinion gear on the azimuth motor 60 engages the teeth in the azimuth gear 40, as depicted in FIGS. 10A and 10B. This allows the azimuth motor 60 to rotate the antenna support 50 about the azimuth gear 40 and thereby control the azimuth direction of the antenna 20.

Figure 11A:
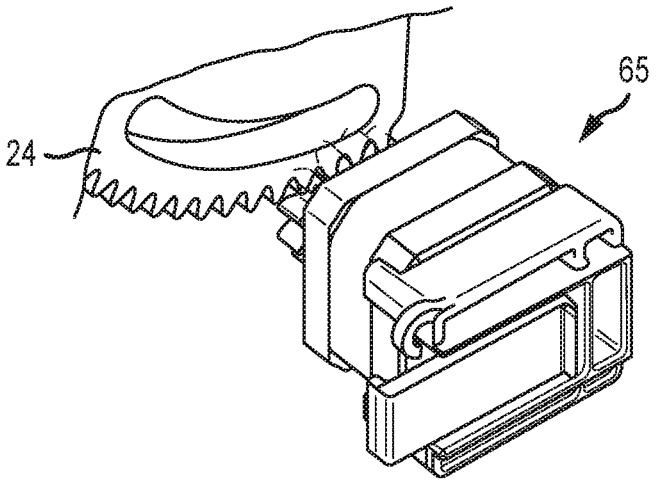
FIG. 11A is a detail axonometric view of the elevation motor 65 driving the elevation gear 24 for the antenna.
Figure 11B:
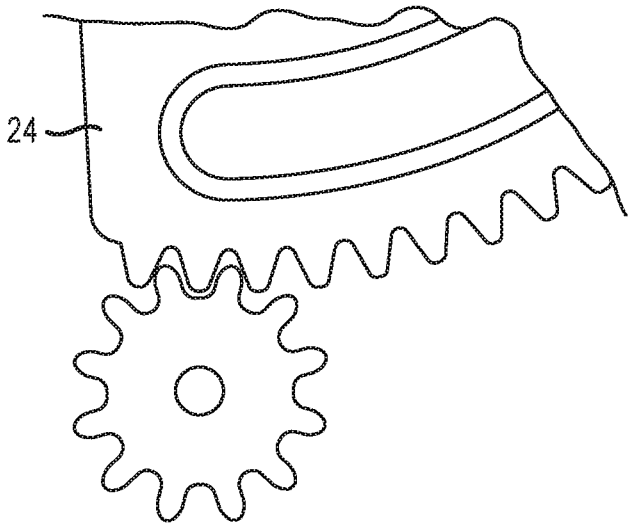
FIG. 11B is a detail side view of the pinion gear of the elevation motor driving the elevation gear 24 of the antenna.

The antenna support 50 has two opposing antenna support arms 56, shown for example in FIGS. 1 and 6, supporting the antenna 20. Two opposing pivot mounts 22 allow the antenna support arms 56 and antenna 20 to rotate in the elevation direction. An elevation gear 24 on the perimeter of one these antenna support arms 56 is driven by a pinion gear on an elevation motor 65 mounted to the antenna support 50 to control the elevation of the antenna 20, as shown in FIGS. 6, 11A and 11B.

Figure 5:
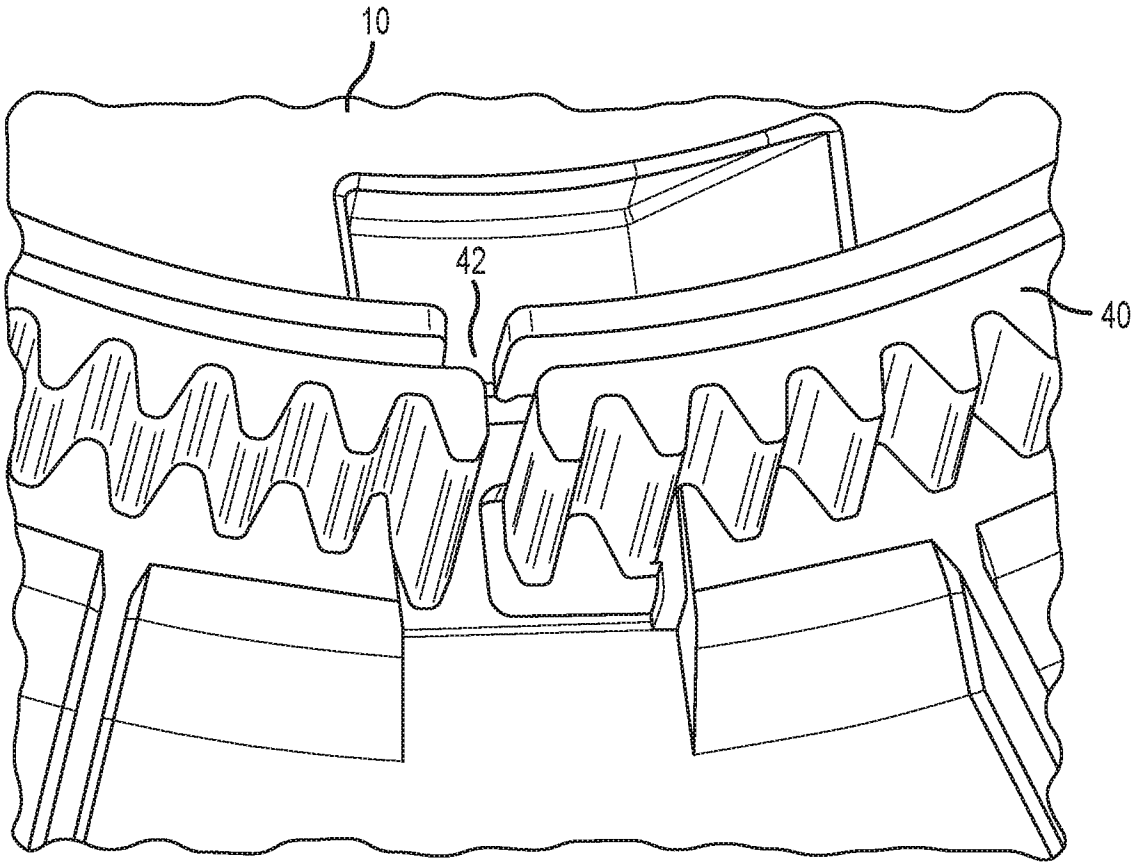
FIG. 5 is a top axonometric view of a portion of the base 10 showing the gap 42 in the azimuth gear 40 allowing wiring 70 to pass through the azimuth gear 40 to the spindle 30.

Optionally, the present invention can include features to address the issues mentioned above with regard to running wires or cables 70 from the base 10 to the antenna support 50 and antenna electronics. For example, a small gap 42 can be formed in the gear surface of the azimuth gear 40 to allow wiring 70 to pass through the azimuth gear 40 and along a passage into the base of the spindle 30, as shown in FIG. 5. The spindle 30 can be hollow with a hole 34 at its upper end, so the wires 70 can run upward through the spindle 30 and exit via an aligned hole 54 at the upper end of the recess 52 in the antenna support 50.

Alternatively, the wiring 70 can pass through the gap 42 in the azimuth gear 40 and then run upward to the antenna support 50 and antenna electronics outside the spindle 30. This could cause the wiring 70 to wrap around the exterior of the spindle 30 as the antenna 20 rotates in the azimuth direction, But, a hardstop can be included in the azimuth gear 40 to prevent the antenna 20 from rotating too far in either direction (e.g., more than 360 degrees) to prevent the wiring 70 from wrap too tightly around the spindle 30.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. An antenna positioning system comprising:
a base;
an antenna;
a hollow spindle extending upward from the base and having a tapered bearing surface;
an azimuth gear on the base centered around the spindle;
an antenna support having opposing elevation support arms extending upward to rotatably support the antenna and allow elevational rotation of the antenna, and having a recess with a tapered surface complementary to the bearing surface of the spindle so that the antenna support is seated over and rotatably supported on the bearing surface of the spindle allowing azimuth rotation of the antenna; said spindle and recess having aligned holes allowing wiring to pass through the spindle and antenna support to the antenna; and
an azimuth motor on the antenna support engaging the azimuth gear to control azimuth rotation of the antenna.

2. The antenna positioning system of claim 1 wherein the recess in the antenna support has a bearing surface with a shape complementary to the bearing surface of the spindle.

3. The antenna positioning system of claim 1 wherein the bearing surface of the spindle is substantially conical.

4. The antenna positioning system of claim 1 wherein the base further comprises a passage below the azimuth gear allowing wiring to pass through the spindle and recess.

5. The antenna positioning system of claim 1 further comprising a motor on the antenna support controlling the elevation of the antenna.

6. An antenna positioning system comprising:
a base;
an antenna;
a spindle extending upward from the base and having a substantially conical bearing surface;
an azimuth gear on the base centered around the spindle;
an antenna support having:
(a) a recess with a substantially conical surface complementary to the bearing surface of the spindle so that the antenna support is rotatably supported on the spindle allowing azimuth rotation of the antenna;
(b) an azimuth motor on the antenna support engaging the azimuth gear to control azimuth rotation of the antenna; and
(c) opposing elevation support arms extending upward to rotatably support the antenna and allow elevational rotation of the antenna.

7. The antenna positioning system of claim 6 further comprising an elevation motor on the antenna support controlling the elevation of the antenna.

8. The antenna positioning system of claim 7 wherein the elevation motor is mounted to an elevation support arm.

9. The antenna positioning system of claim 6 wherein the spindle is hollow, and wherein the spindle and recess further comprise aligned holes allowing wiring to pass through the spindle and antenna support.

10. The antenna positioning system of claim 6 wherein the base further comprises a passage below the azimuth gear allowing wiring to pass through the spindle and recess.

* * * * *